US005199861A

United States Patent [19]

Merlo et al.

[11] Patent Number: 5,199,861

[45] Date of Patent: Apr. 6, 1993

[54] LIFTING TRUCK WITH A TELESCOPIC LIFTING ARM

[75] Inventors: Amilcare Merlo, Cuneo; Renato Galfre', San Dalmazzo, both of Italy

[73] Assignee: Merlo S.P.A. Industria Metalmeccanica, Cuneo, Italy

[21] Appl. No.: 458,686

[22] PCT Filed: Jul. 19, 1988

[86] PCT No.: PCT/EP88/00647

§ 371 Date: Jan. 26, 1990

§ 102(e) Date: Jan. 26, 1990

[87] PCT Pub. No.: WO89/00972

PCT Pub. Date: Feb. 9, 1989

[30] Foreign Application Priority Data

Jul. 27, 1987 [IT] Italy ..... 53559/87[U]

[51] Int. Cl.[5] ..... E02F 3/28

[52] U.S. Cl. ..... 414/718; 180/89.12

[58] Field of Search ..... 414/680, 685, 718, 728; 180/292, 317, 308, 65.5, 89.12; 212/182, 184, 187

[56] References Cited

U.S. PATENT DOCUMENTS

| | | | |
|---|---|---|---|
| Re. 30,021 | 6/1979 | Olson | 414/547 |
| 2,591,584 | 4/1952 | Moon | 180/317 X |
| 3,967,744 | 7/1976 | Goyarts | 414/718 X |
| 4,210,219 | 7/1980 | Oswald et al. | 180/292 X |
| 4,345,873 | 8/1982 | Wymore | 414/714 |
| 4,382,743 | 5/1983 | Newell | 414/692 |

FOREIGN PATENT DOCUMENTS

| | | | |
|---|---|---|---|
| 2301777 | 7/1974 | Fed. Rep. of Germany | 414/685 |
| 2739537 | 3/1978 | Fed. Rep. of Germany . | |
| 2287413 | 5/1976 | France . | |
| 2545468 | 11/1984 | France . | |

*Primary Examiner*—Michael S. Huppert
*Assistant Examiner*—Donald W. Underwood
*Attorney, Agent, or Firm*—Sughrue, Mion, Zinn, Macpeak & Seas

[57] ABSTRACT

In a lifting truck of the type comprising a wheeled structure carrying a lifting arm articulated to the rear of the structure and a cab situated on one side of the structure at one side of the longitudinal axis of the structure, the internal combustion engine which propels the truck and operates the arm is disposed in a housing which is situated on the opposite side of the longitudinal axis to the cab and is spaced from the cab so as to form therewith a space at least as wide as the lifting arm. The arm is articulated to the structure of the truck in such a position that, in its completely lowered position, it is partly housed in the space so as not to interfere with the view of the operator working in the driving cab.

1 Claim, 3 Drawing Sheets

LIFTING TRUCK WITH A TELESCOPIC LIFTING ARM

BACKGROUND OF THE INVENTION

The present invention relates to a lifting truck of the type comprising a wheeled structure carrying a telescopic lifting arm articulated to the rear of the structure about a horizontal axis perpendicular to the longitudinal axis of the truck, an internal combustion engine supported by the structure for the propulsion of the truck and for the operation of the arm, and a driving and operating cab situated on one side of the structure to one side of the longitudinal axis of the structure.

Lifting trucks of the aforementioned type generally have the disadvantage that they do not provide sufficient visibility to the side and to the rear for the operator working in the operating and driving cab. In fact, in lifting trucks currently available on the market, the lifting arm is articulated on an axis which is perpendicular to the longitudinal axis of the vehicle to the upper end of an upright which extends vertically above a rear housing of the structure in which the internal combustion engine is housed. The lifting arm thus obstructs in its completely lowered position, the operator's view to the side, and to the rear, which poses problems, particularly as regards working safety.

The particular object of the present invention is to produce a lifting truck of the type defined above which is formed in such a way as to improve the operator's field of view.

SUMMARY OF THE INVENTION

According to the invention, this object is achieved by virtue of the fact that the internal combustion engine is disposed in a housing which is situated on the opposite side of the longitudinal axis to the cab and is spaced from the cab so as to define with the cab a space having a width at least equal to the width of the lifting arm, and by virtue of the fact that the lifting arm is articulated to the structure of the truck in such a position that, in its completely lowered position, it is partly accommodated in the space so as not to interfere with the view of the operator working in the driving cab.

Further characteristics and advantages of the truck according to the invention will become clear in the course of the detailed description which follows with reference to the appended drawings, provided by way of non-limiting example, in which:

DETAILED DESCRIPTION OF THE INVENTION

Figure 1:
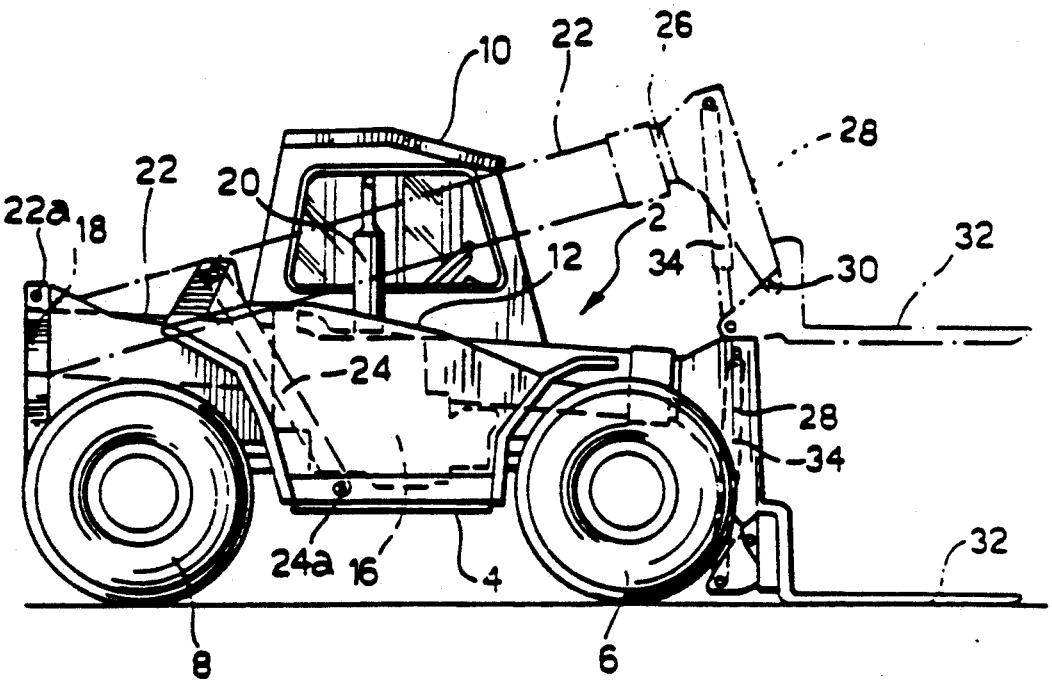
FIG. 1 is a side elevational view of a fork-lift truck.
Figure 3:
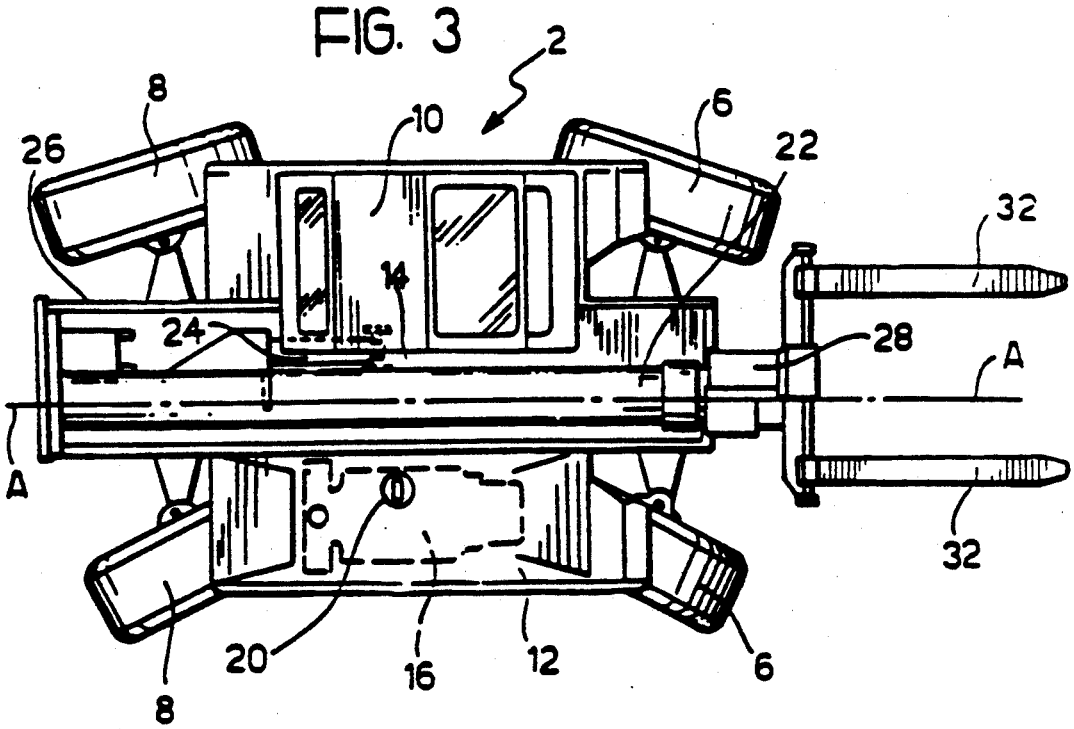
FIG. 3 is a view of the truck of FIG. 1 from above.
Figure 2:
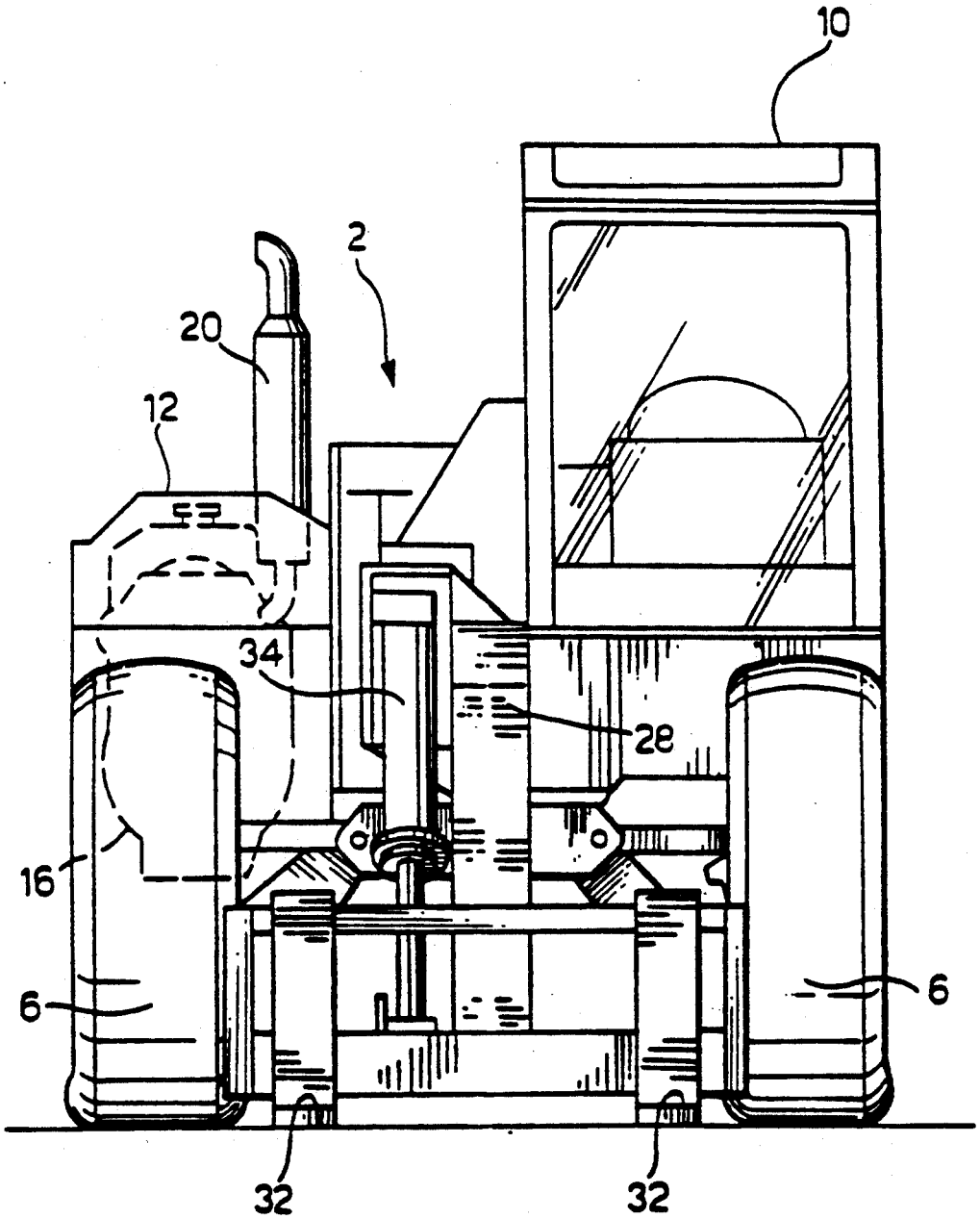
FIG. 2 is a front elevational view of the truck of FIG. 1.

With reference to FIGS. 1 to 3, a lifting truck, generally indicated 2, includes a support platform structure 4 provided with front and rear wheels 6 and 8 respectively, and with a telescopic lifting arm 22, articulated to the rear end of an upright 18 carried by the structure 4. The platform 4 supports a driving cab 10 situated on one side of the platform 4 and to one side of the longitudinal axis A—A of the truck.

On the opposite side of the axis A—A to the driving cab, the platform supports a housing 12 in which a longitudinally-extending internal combustion engine 16, provided with a vertically-directed exhaust pipe 20, is housed. The housing 12 is positioned at a distance from the cab 10 so as to define with the cab a space 14 which is at least as wide as the lifting arm 22.

The lifting arm 22 is articulated about a horizontal pin 22*a* transverse the axis A—A and situated at a level such that the arm is partly accomodated in the space 14 in its completely lowered position. In FIG. 1, the telescopic arm 22 is illustrated in its completely retracted position, being shown in broken outline in a partially raised position, and in continuous outline in its completely lowered position in which it extends longitudinally adjacent the cab 10 in the space 14 and does not interfere with the view of the operator working in the driving cab. In particular, the top of the engine housing 12, the axis of the articulation pin 22*a* of the lifting arm, and the top of the lifting arm 22 in its completely lowered position are all situated at a lower level than the line of sight of the operator working in the cab.

The lifting arm 22 is pivoted about the pin 22*a* by means of a hydraulic jack 24 the lower part of which is articulated at 24*a* to the central part of the platform 4. When the arm 22 is in the lowered position, the jack 24 is inclined forwardly and downwardly.

The inner slidable end element 26 of the telescopic arm 22 carries a head 28 to which an implement 32, which is pivoted by means of a jack 34, is articulated about a pin 30.

In the embodiment illustrated, the implement 32 is constituted by a forked platform; this platform may, however, be replaced by other types of implement, for example, by a bucket.

Figure 4:
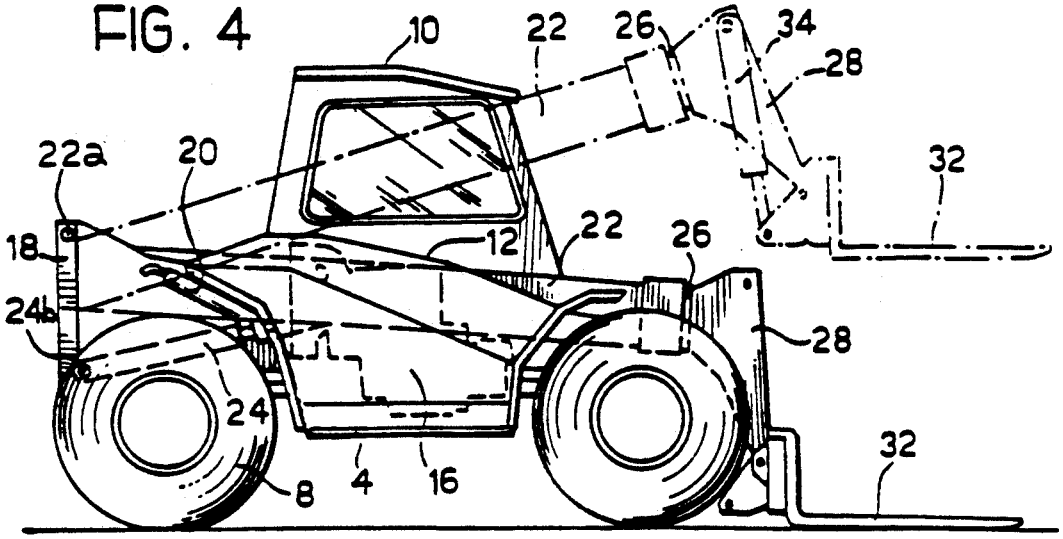
FIG. 4 is a view similar to FIG. 1 of a variant.
Figure 5:
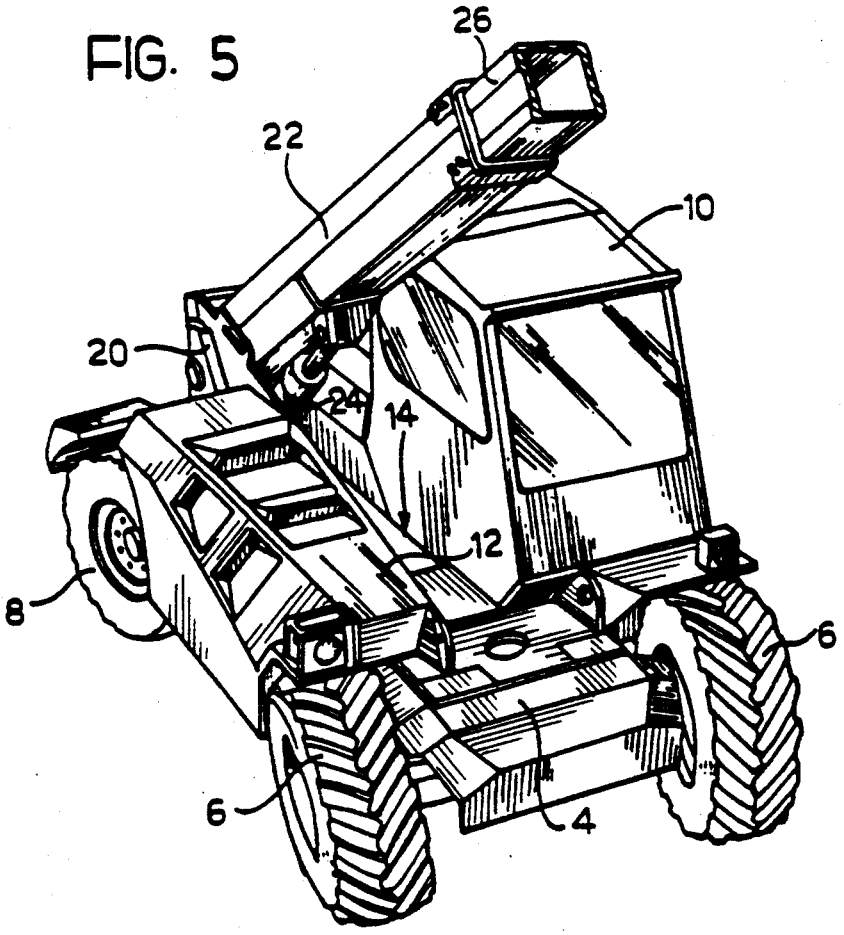
FIG. 5 is a perspective view of the vehicle shown in FIG. 4.

The variant illustrated in FIGS. 4 and 5 differs from the embodiment described above in that the jack 24 which causes the pivoting of the lifting arm 22 is articulated at the rear to the chassis of the truck about a pin 24*b* at the base of the upright 18, and is inclined forwardly and upwardly when the arm 22 is in the lowered position. Moreover, the exhaust pipe 20 is directed towards the rear part of the vehicle with a slight upward inclination, instead of being vertical.

By virtue of the characteristics of the truck according to the invention, not only the operator's view to the side and to the rear but also the characteristics of stability, manoeuvrability, accessibility, thrust force and habitability of the truck are improved. In fact, by virtue of the above-described positioning of the engine and the lifting arm, there is also a substantial lowering of the centre of gravity of the truck with obvious advantages in terms of its aforementioned characteristics and of its safety in use.

What is claimed is:

1. A lifting truck comprising a wheeled structure carrying a lifting arm (22) articulated to the rear of the structure about a horizontal axis perpendicular to the longitudinal axis (A—A) of the truck, an internal combustion engine (16) supported by the structure for propulsion of the truck and for the operation of the arm (22), and an operating and a driving cab (10) situated on one side of the structure to one side of the longitudinal axis (A—A), said driving cab including two side windows, the internal combustion engine (16) being longitudinally placed, that is with its shaft parallel to the longitudinal axis (A—A) to the cab (10) substantially below the line of sight of the operator and is spaced from the cab so as to define with the cab a space (14) having a width at least equal to the width of the telescopic lifting arm (22), the telescopic lifting arm being articulated to the extreme rear structure of the truck at a height which substantially corresponds to the height of the lower edge of said side windows so that, in its completely lowered position, the arm is partly accommodated in said space (14) in a substantially horizontal plane substantially below a horizontal plane tangent to the top of the engine (16) so as not to interfere with the view of the operator working in the driving cab.

* * * * *